US009650185B2

(12) United States Patent
Kieffer et al.

(10) Patent No.: US 9,650,185 B2
(45) Date of Patent: May 16, 2017

(54) TAMPER EVIDENT CLOSURE

(71) Applicant: Currier Plastics, Inc., Auburn, NY (US)

(72) Inventors: Gary John Kieffer, Moravia, NY (US); Joel Robin Sieber, Stanley, NY (US); Steven Michael Faes, Canisteo, NY (US); Massimo A. Leone, Penfield, NY (US)

(73) Assignee: Currier Plastics, Inc., Auburn, NY (US)

( * ) Notice: Subject to any disclaimer, the term of this patent is extended or adjusted under 35 U.S.C. 154(b) by 0 days.

(21) Appl. No.: 14/662,692

(22) Filed: Mar. 19, 2015

(65) Prior Publication Data

US 2015/0266632 A1 Sep. 24, 2015

Related U.S. Application Data

(60) Provisional application No. 61/968,034, filed on Mar. 20, 2014.

(51) Int. Cl.
*B65D 43/16* (2006.01)
*B65D 47/08* (2006.01)
*B65D 43/02* (2006.01)

(52) U.S. Cl.
CPC ..... *B65D 47/0838* (2013.01); *B65D 43/0235* (2013.01); *B65D 2101/0023* (2013.01)

(58) Field of Classification Search
CPC ..... B65D 43/0235; B65D 47/0838; B65D 43/163; B65D 2101/0023; B65B 7/28
USPC ..... 215/235, 237, 253; 220/254.3, 266; 222/556
See application file for complete search history.

(56) References Cited

U.S. PATENT DOCUMENTS 4,487,324 A * 12/1984 Ostrowsky ..... B65D 47/0814 215/225
4,711,372 A * 12/1987 Gach ..... B65D 47/0885 206/807
4,919,285 A 4/1990 Roof et al.
4,941,592 A * 7/1990 Kitterman ..... B65D 55/024 215/241
4,974,735 A * 12/1990 Newell ..... B65D 41/58 215/235
5,123,561 A * 6/1992 Gross ..... B65D 47/0838 215/237
5,201,440 A * 4/1993 Gross ..... B65D 47/0861 215/203
5,685,444 A * 11/1997 Valley ..... B65D 55/024 215/237
5,875,907 A 3/1999 Lay
6,405,885 B1 6/2002 Elliott
7,281,638 B2 10/2007 Hierzer et al.
(Continued)

*Primary Examiner* — James N Smalley
(74) *Attorney, Agent, or Firm* — Timothy W. Menasco, Esq.; Harter Secrest & Emery LLP

(57) ABSTRACT

A tamper evident closure employs a frangible tamper evident finger for initially retaining a lid in a closed position relative to a closure body. In response to an initial opening of the lid, the finger is separated from the lid and retained in a volume at least partly defined by the closure body. As the finger is connected to the lid by a frangible bridge in a confirmation window, upon separation of the finger from the lid, the now open confirmation window provides immediate and ready indication that the lid has been opened.

11 Claims, 13 Drawing Sheets

(56) References Cited

U.S. PATENT DOCUMENTS

| | | | | |
|---|---|---|---|---|
| 8,413,832 | B2 | 4/2013 | Mazurkiewicz et al. | |
| 2006/0011573 | A1 * | 1/2006 | Herald | B65D 47/0804 215/237 |
| 2008/0047976 | A1 * | 2/2008 | Scheer | B65D 47/0809 222/153.06 |

* cited by examiner

TAMPER EVIDENT CLOSURE

CROSS REFERENCE TO RELATED APPLICATIONS

This nonprovisional application claims benefit of U.S. provisional application No. 61/968,034 filed Mar. 20, 2014 whose contents in entirety are hereby expressly incorporated by reference.

BACKGROUND OF THE INVENTION

Field of the Invention

The present disclosure relates to tamper evident systems for containers wherein the system must be altered in some manner to obtain access to the container contents, the alteration being evidence that the container has been opened. The present system is particularly suited for a tamper evident construction, wherein an immediate visual indicator is provided through separation of a portion of a closure upon actuation of the tamper evident system.

Description of Related Art

A variety of tamper evident container closures have been developed. U.S. Pat. No. 4,487,324 and No. 4,941,592 disclose closures which incorporate a locking band or tab that is attached to either the lid or body of the closure with a plurality of frangible webs so as to initially retain the closure lid to the body in the closed position. To initially open the closure, the user must break the frangible webs by pushing or pulling on a tab or band.

U.S. Pat. No. 5,201,440 describes a container closure which includes a body for mounting on a container. The tamper indicating member includes a pull tab which can be pulled to completely sever frangible webs connecting the tamper indicating member to a lid and an anchor. The lid can then be opened while providing evidence of tampering with the closure.

Even in view of the above disclosures, it is desirable to provide an improved tamper evident closure which can be readily fabricated and which, prior to the initial opening, can provide an aesthetic appearance, yet provide ready visual indication of the tamper evident status. It would also be advantageous for a tamper evident closure to be easily molded as one piece, including lid, body and tamper-indicating portion, and to be easily deployed after molding to a tamper indicating ready condition for eventual delivery to a user.

Specifically, it would be an improvement if the closure could be initially opened relatively easily by the user. After such an improved closure has been initially opened, the closure should furnish a very clear visible indication that it has been previously opened. It would also be desirable to provide an improved tamper evident closure design that includes a tamper indicator which, when altered during opening of the closure, would not result in the creation of a separate scrap piece that would require separate disposal.

BRIEF SUMMARY OF THE INVENTION

In view of the foregoing, it is an object of the present disclosure to provide a method, a closure for a container, and a tamper evident closure device.

A first exemplary embodiment of the present system provides a tamper evident closure, including a body having a top wall including a dispensing port aligned with an outlet of a container, a depending peripheral skirt, a sealing flange selected to form a sealed interface with the container and a locking skirt having an engaging boss sized to engage a surface of the container to resist non-destructive separation of the body from the container, the top wall further including a capture aperture; and a lid hingedly connected to the body and moveable between an open position and a closed position, the lid including a sealing surface for sealingly engaging the container in the closed position, the sealing surface being spaced from the dispensing port in an open position of the lid, the lid including a tamper evident finger projecting from the lid, the finger including a retaining barb, where in the closed position of the lid, a portion of the finger passes through the capture aperture and a thickness of a local region of the top wall is between the retaining barb and a bottom surface of the lid, the finger connected to the lid in a confirmation window by a frangible bridge, the finger configured to pass through the capture aperture a single time and upon sufficient opening force on the lid, the frangible bridge breaks allowing the lid to move to the open position and the separated finger is retained in a volume defined by an external surface of the container and an internal surface of the peripheral skirt.

A second exemplary embodiment of the present disclosure provides a method. The method includes affixing a closure body to form a sealed interface with an outlet of a container, the enclosure body including a dispensing port aligned with the outlet. The method further includes moving a lid hingedly attached to the enclosure body from a closed position to an open position, the lid in the closed position (i) occluding the dispensing port and (ii) locating a portion of a tamper evident finger within a capture aperture of the closure body to locate a portion of the closure body between a retaining barb of the capture finger and the lid, the tamper evident finger connected to the lid in a confirmation window by a frangible bridge. The method still further includes moving the lid to an open position to break the frangible bridge and separate the tamper evident finger from the lid and locate the separated finger in a volume between an external surface of the container and a skirt of the enclosure body A third exemplary embodiment of the present disclosure provides A closure for a container that has an opening to a container interior where a product may be stored. The closure includes a closure body that is one of (i) a separate structure for being attached to the container at the opening or (ii) a structure formed as a unitary portion of the container at the opening, the closure body having a dispensing orifice for containing with the container opening. The closure further includes a lid connected to the body by a hinge and moveable between a closed position occluding the dispensing orifice and an open position spaced from the dispensing orifice, the lid having a lifting region against which a force can be applied by the user to move the lid from the closed position to the open position. The closure still further includes a tamper evident finger frangibly connected to the lid with a frangible bridge in a confirmation window, the tamper evident finger having a retaining barb spaced from an underside of the lid by sufficient distance to locate a portion of the closure body intermediate the retaining barb and the lid in the closed position of the lid. The closure further includes a first movement of the lid from the closed position to the open position fracturing the frangible bridge and permitting movement of the lid from the closed position to the open position and retaining the separated finger within the closure body.

The following will describe embodiments of the present disclosure, but it should be appreciated that the present disclosure is not limited to the described embodiments and various modifications of the invention are possible without departing from the basic principle. The scope of the present disclosure is therefore to be determined solely by the appended claims.

DETAILED DESCRIPTION OF THE INVENTION

The present disclosure provides a closure, wherein the closure can be configured as a dispensing cap for engaging a container such as a bottle or tube. It is anticipated that exemplary embodiments of the presented container can retain solid and/or liquid products. Typical containers include those for amenities often found in hotels, spas, and resorts. Exemplary amenities can include soaps, lotions, washes and shampoos. However, it is understood that exemplary embodiments of the present disclosure are not limited to particular containers or products.

Figure 1:
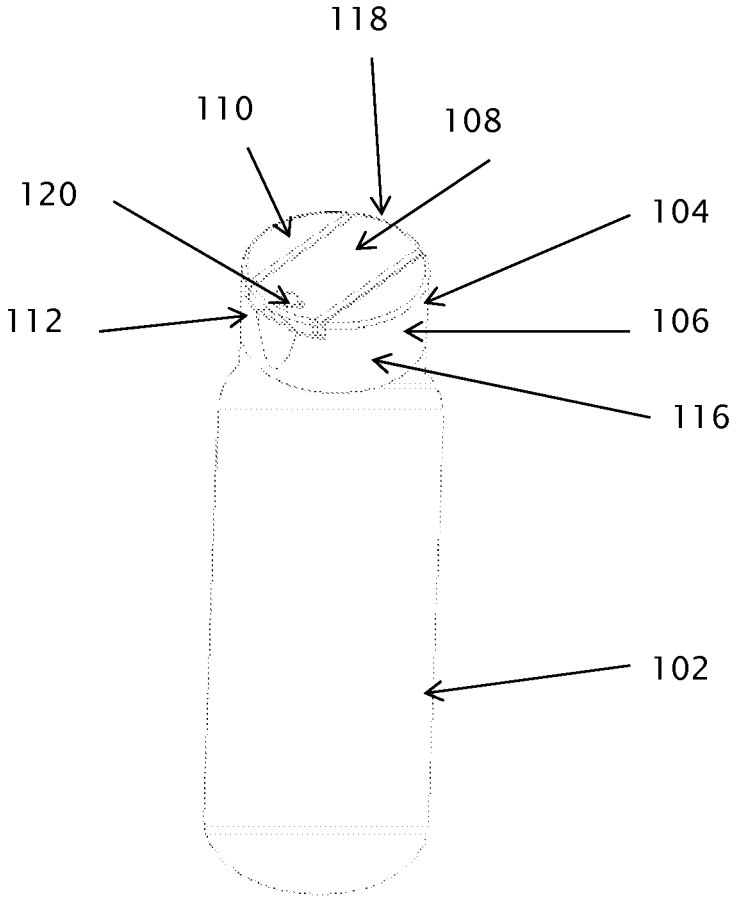
FIG. 1 is a perspective view of an exemplary container having an exemplary tamper evident closure.

Referring to FIG. 1, shown is a perspective view of an exemplary container 102 having an exemplary tamper evident closure. FIG. 1 depicts a container 102 with a closure 104 that includes a closure body 106 and a lid 108. The closure body 106 includes a top wall 110, and a peripheral skirt 112. As is evident, container 102 including closure body 106 and lid 108 can have a substantially cylindrical cross section.

As shown in FIG. 1, the top wall 110 has a circular periphery with the peripheral skirt 112 depending from and extending away from top wall 110, such as extending downward from top wall 110. Top wall 110 can include a flat or recessed land sized to receive a portion of the lid 108. Peripheral skirt 112 defines an inside surface 114 (not shown) and an outside surface 116. As seen in FIG. 1, outside surface 116 of peripheral skirt 112 can be aligned with the outside of container 102 or at least a local portion of container 102.

Lid 108 is moveable between an open position and a closed position relative to closure body 106. Lid 108 can be hingedly connected or coupled to closure body 106 via hinge 118. In another exemplary embodiment, lid 108 can be separable from closure body 106. Exemplary embodiments of hinge 118 can be any of a variety of configurations known in the art including a living hinge.

Alternatively, closure body 106 and lid 108 can be formed as separate components and joined in a pivoting relationship, such as by detents or pins formed on one of closure body 106 and lid 108 with corresponding recesses or sockets to receive the pins on the remaining of lid 108 or closure body 106. In yet another exemplary embodiment, lid 108 and closure body 106 can be formed as a one-piece integral construction. For example, closure body 106 and lid 108 can be injection molded in a single mold in a single, double, or multiple shot to form an integral closure. In one exemplary configuration, lid 108 has a thickness such that in the closed position, lid 108 is received in a land area of closure body 106 and a top surface of lid 108 is substantially coplanar with an adjacent or exposed surface of top wall 110, as seen in FIG. 1. Lid 108 further includes a confirmation window 120, which provides a ready, visual indication of whether lid 108 has been opened.

Figure 2:
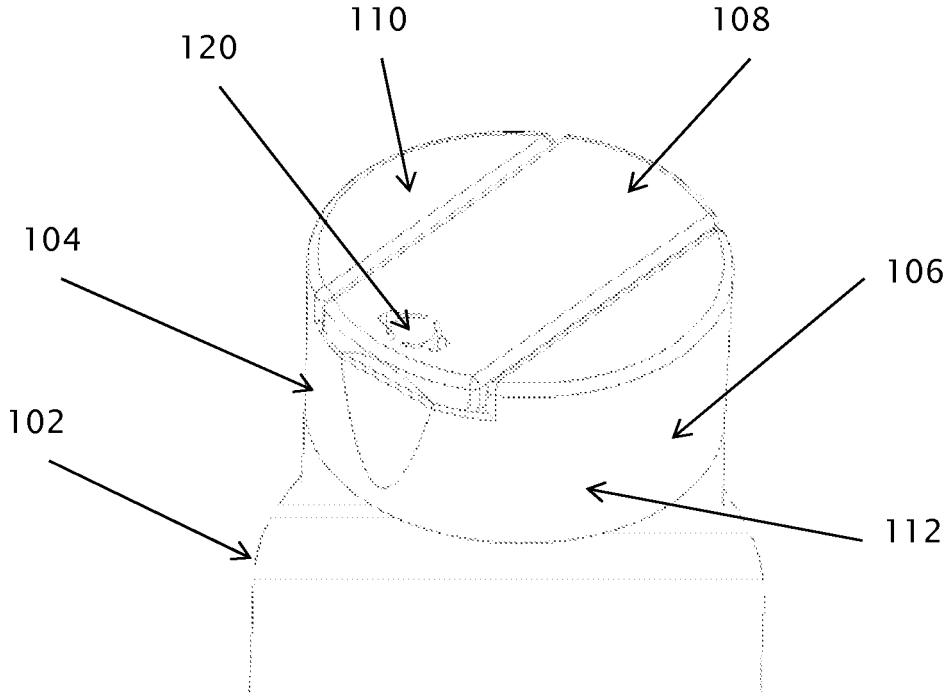
FIG. 2 is a perspective view of an exemplary container having an exemplary tamper evident closure.

Reference is now made to FIG. 2, which illustrates a close up perspective view of an exemplary container having an exemplary tamper evident closure. Shown in FIG. 2 is container 102 with closure 104. Closure 104 includes closure body 106, with top wall 110, peripheral skirt 112, confirmation window 120 and lid 108.

Figure 3:
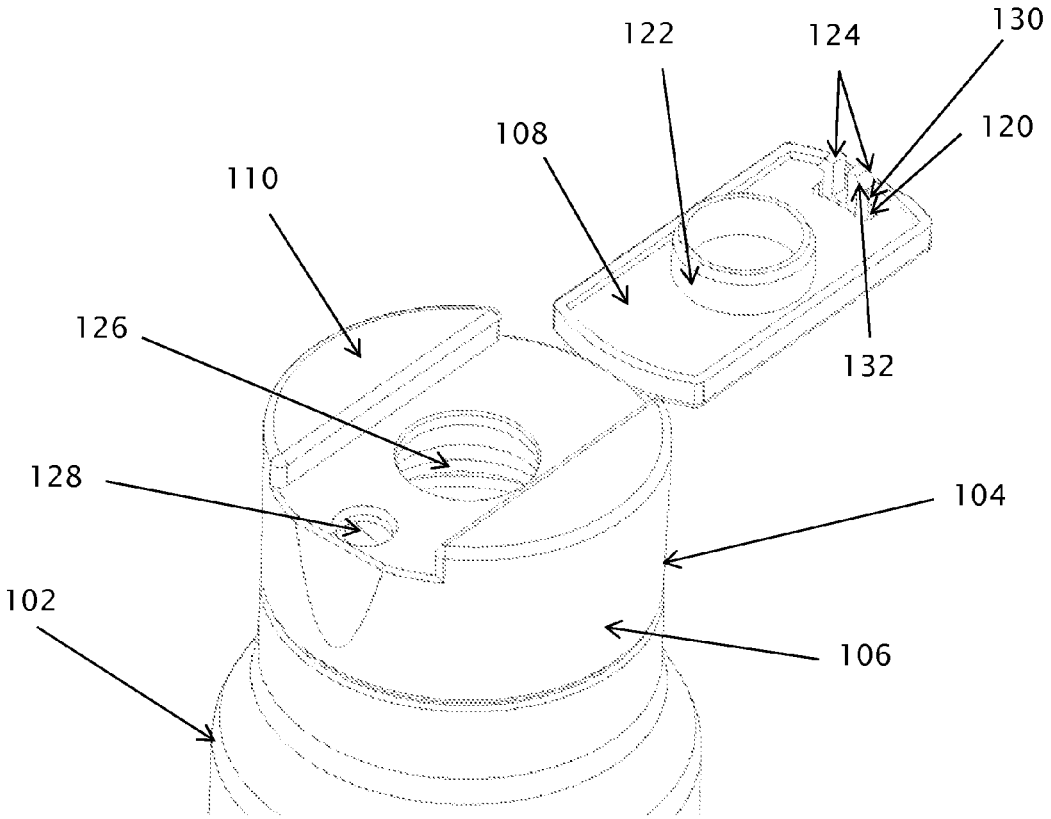
FIG. 3 is a perspective view of an exemplary closure in a fully open position, prior to an initial closing.

Referring to FIG. 3, shown is a perspective view of an exemplary closure in a fully open position, prior to an initial closing. Depicted in FIG. 3 is container 102 and closure 104. Closure 104 includes closure body 106 and lid 108 with confirmation window 120. As depicted in FIG. 3, lid 108 is in the open position and the underside of lid 108 is illustrated, which includes a sealing surface 122 and two tamper evident fingers 124. Exemplary embodiments of sealing surface 122 releasably and sealingly engage a dispensing port 126 in top wall 110 to form a sealed interface there between. Dispensing port 126 provides an opening through top wall 110 of closure 104 to an interior of container 102. Top wall 110 includes dispensing port 126 located to substantially align with at least a portion of the outlet of container 102. Exemplary embodiments of dispensing port 126 can be configured in any known shape or size provided that it allows solids and/or liquids to enter and exit container 102 through dispensing port 126.

Also shown in FIG. 3 is top wall 110, which further includes a capture aperture 128. In one exemplary embodiment, capture aperture 128 is spaced from dispensing port 126. As seen in FIG. 3, capture aperture 128 exposes a volume generally defined by an external surface of the neck of container 102, the inside surface of peripheral skirt 114 and a bottom surface of top wall 110.

Lid 108 includes two tamper evident fingers 124, however, exemplary embodiments of lid 108 may include one or more projecting capture (tamper evident) fingers 124 connected to lid 108 by a frangible bridge 130 at confirmation window 120. In alternative embodiments, lid 108 includes a plurality of tamper evident fingers 124, such as capture fingers, wherein the tamper evident fingers 124 may be connected to lid 108 by a corresponding plurality of frangible bridges 130 in confirmation window 120.

Tamper evident fingers 124 include a retaining barb 132 projecting away from a longitudinal dimension of tamper evident fingers 124. In one exemplary embodiment, retaining barb 132 on the finger is sized to engage an underside of top wall 110 when lid 108 is in the closed position, thereby assisting in retaining lid 108 in the closed position. Further, a bottom surface of the lid 108 (contacting body 104) can be configured in cooperation with the retaining barb 132 on the tamper evident finger 124, such that upon engagement of retaining barb 132 with the underside of top wall 110, the bottom surface of lid 108 is against an upper surface of top wall 110. This sizing promotes retention of lid 108 in a mutual closed position.

Tamper evident fingers 124 are resilient and moveable between a flexed and unflexed position. Tamper evident fingers 124 move from the unflexed position to the flexed (compressed) position upon passing retaining barbs 132 through the capture aperture 128. Upon retaining barbs 132 passing completely through capture aperture 128, the bias of the flexed tamper evident fingers 124 urges the tamper evident fingers 124 toward the unflexed position and retaining barbs 132 engage lid 108. Capture aperture 128 and tamper evident fingers 124 can be configured to dispose the tamper evident fingers 124 in the unflexed or partly flexed position upon retaining barbs 132 having passed through capture aperture 128.

Figure 4:
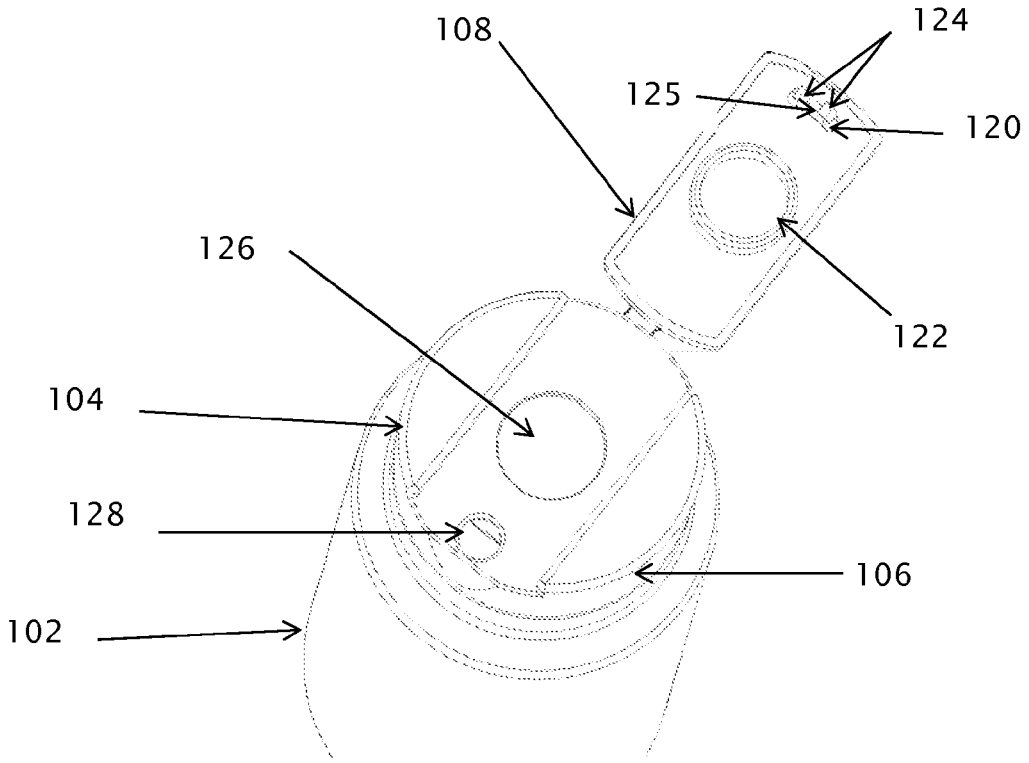
FIG. 4 is a top perspective view of an exemplary closure in a fully open position, prior to an initial closing.

Reference is now made to FIG. 4, which depicts a top perspective view of an exemplary closure in a fully open position, prior to an initial closing. Shown in FIG. 4 is container 102 and closure 104. Closure 104 includes closure body 106, with sealing surface 122, confirmation window 120, tamper evident fingers 124, dispensing port 126, capture aperture 128 and lid 108.

It should be noted that in the exemplary embodiment shown in FIG. 4, lid 108 is depicted as being separable from closure body 106. However, exemplary embodiments of lid 108 include lid 108 being moveably coupled or connected to body 104 and moveably separable from closure body 106.

In one exemplary embodiment, tamper evident fingers 124 include a hub 125 initially located in confirmation window 120 and having an upper surface substantially coplanar with an adjacent portion of top wall 110. In this embodiment, hub 125 or hub portion of tamper evident fingers 124 is connected to lid 108 in confirmation window 120 by frangible bridges 130. In the configurations having a plurality of tamper evident fingers 124, in one configuration the tamper evident fingers 124 are joined at a common hub 125, wherein hub 125 is connected to lid 108 in confirmation window 120 by frangible bridges 130. Thus, upon fracture of frangible bridges 130, tamper evident fingers 124 and hub 125 remain as a single unit, though now separate from lid 108 and no longer within confirmation window 120.

Exemplary embodiments of confirmation window 120 can have a periphery that is not dictated by the frangible bridges 130. Therefore, upon the absence of tamper evident fingers 124, and hub 125, an open confirmation window 120 provides a ready, visual indication of the presence or absence of the tamper evident fingers 124—and hence an indication of whether lid 108 has been previously opened. That is, the presence or absence of the tamper evident fingers 124, hub 125 and frangible bridges 130 in confirmation window 120 corresponds to an opening of lid 108 relative to the body 104.

Figure 5:
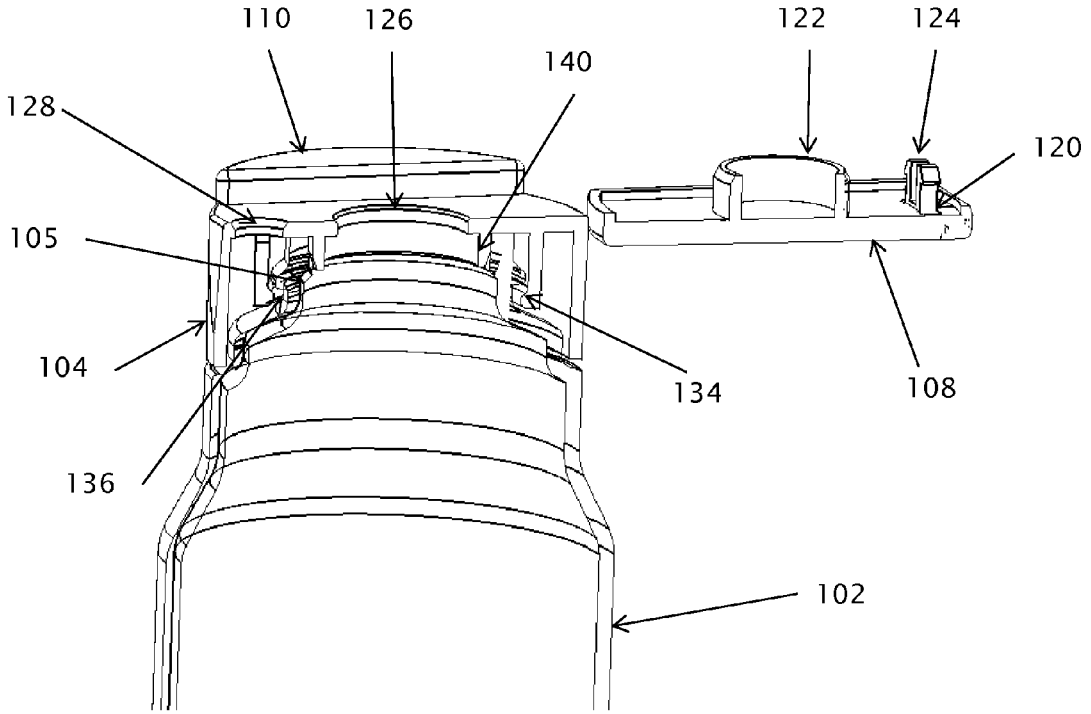
FIG. 5 is a first cross sectional view of an exemplary closure in a fully open position, prior to an initial closing.

Reference is now made to FIG. 5, which shows a first cross sectional view of an exemplary closure in a fully open position, prior to an initial closing. Shown in FIG. 5 is container 102 with closure 104. Closure 104 includes closure body 106, with sealing surface 122, confirmation window 120, tamper evident fingers 124, dispensing port 126, capture aperture 128, top wall 110 and lid 108.

Closure body 106, as shown in FIG. 5, includes a locking skirt 134 depending from the top wall 110. As shown, locking skirt 134 is circumscribed by the peripheral skirt 112. That is, locking skirt 134 confronts the inside surface of the peripheral skirt 112. Subject to the particular configuration of the engaging structure of container 102, locking skirt 134 includes a boss 136 such as an annular ridge for engaging container 102 to retain the closure body 106 relative to the container 102. Locking skirt 134 can be in the form of a substantially continuous periphery or have gaps. Alternatively, locking skirt 134 can be in the form of a plurality of locking tabs 138 (not shown). Locking tabs 138 have a sufficient resistance to deformation and sufficient contact with the container 102 to substantially preclude non-destructive separation of closure body 106 from the container 102.

In one configuration, locking skirt 134 of closure body 106 extends substantially about a circumference of container 102, with the exception of a cut out portion, which is aligned with capture aperture 128. By removing a portion of locking skirt 134 below capture aperture 128, a portion of the tamper evident fingers 124 can pass through capture aperture 128 without interfering with locking skirt 134. Thus, the present closure body 106 has a reduced diameter providing efficient manufacture and reduced material requirements.

FIG. 5 also depicts sealing flange 140 of the closure body 106, which engages the container 102 in the area of the outlet to form a substantially fluid-tight seal between the closure body 106 and the container 102. Although sealing flange 140 of the closure body 106 is shown forming a sealed interface with an inside surface of the container 102 outlet, it is understood the sealing interface between closure body 106 and container 102 can be formed by a variety of known mechanisms including internal or external threads on either of closure body 106 or container 102 as well as sealing flange 140 engaging an outside surface of container 102.

In one exemplary configuration, the container 102 includes a neck 105 converging to an outlet, wherein the outlet has a circular cross section. An outer surface of the neck includes an engaging structure such as an annular rib or plurality of projecting tabs.

Figure 6:
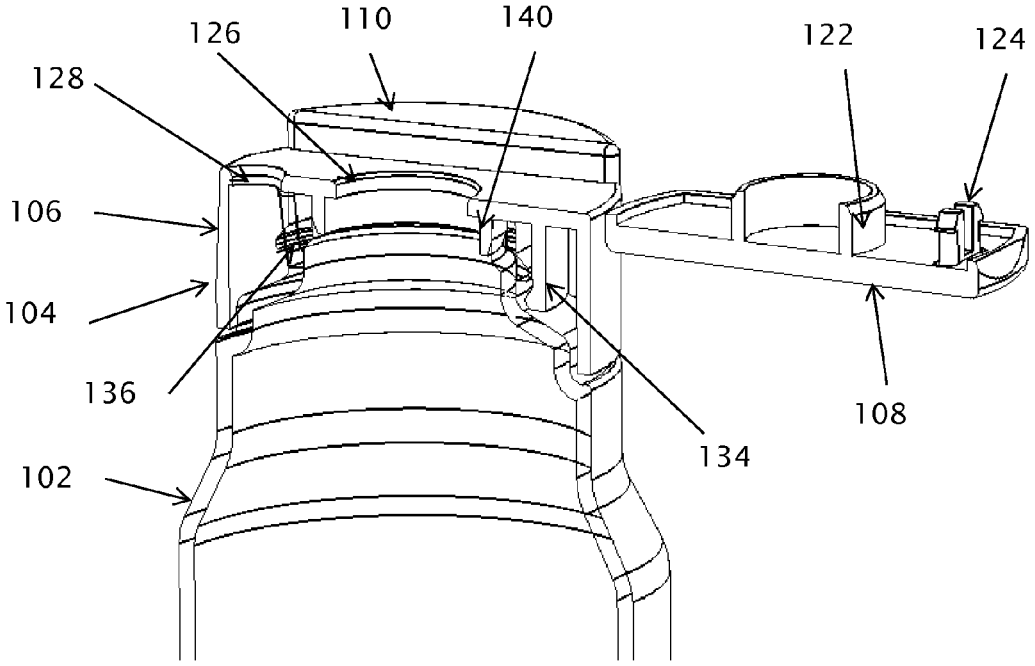
FIG. 6 is a second cross sectional view of an exemplary closure in a fully open position, prior to an initial closing.

Referring to FIG. 6, shown is a second cross sectional view of an exemplary closure in a fully open position, prior to an initial closing. Illustrated in FIG. 6 is container 102 and closure 104. Closure 104 includes closure body 106, lid 108, sealing surface 122, tamper evident fingers 124, dispensing port 126, capture aperture 128, locking skirt 134, boss 136, sealing flange 140, and top wall 110.

Figure 7:
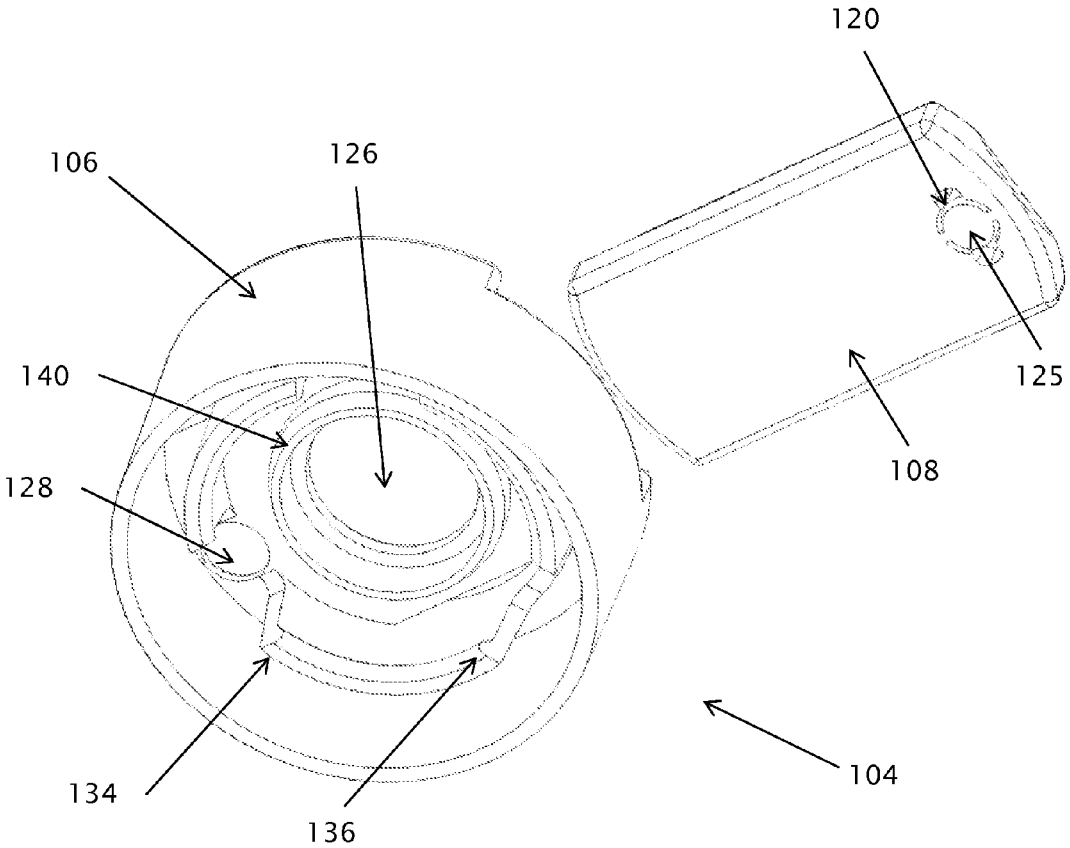
FIG. 7 is a bottom perspective view of an exemplary closure in a fully open position, prior to an initial closing.

Referring to FIG. 7, shown is a bottom perspective view of an exemplary closure in a fully open position, prior to an initial closing. Shown in FIG. 7 is closure 104 with closure body 106, lid 108, confirmation window 120, hub 125, dispensing port 126, capture aperture 128, locking skirt 134, boss 136, and sealing flange 140.

Figure 8:
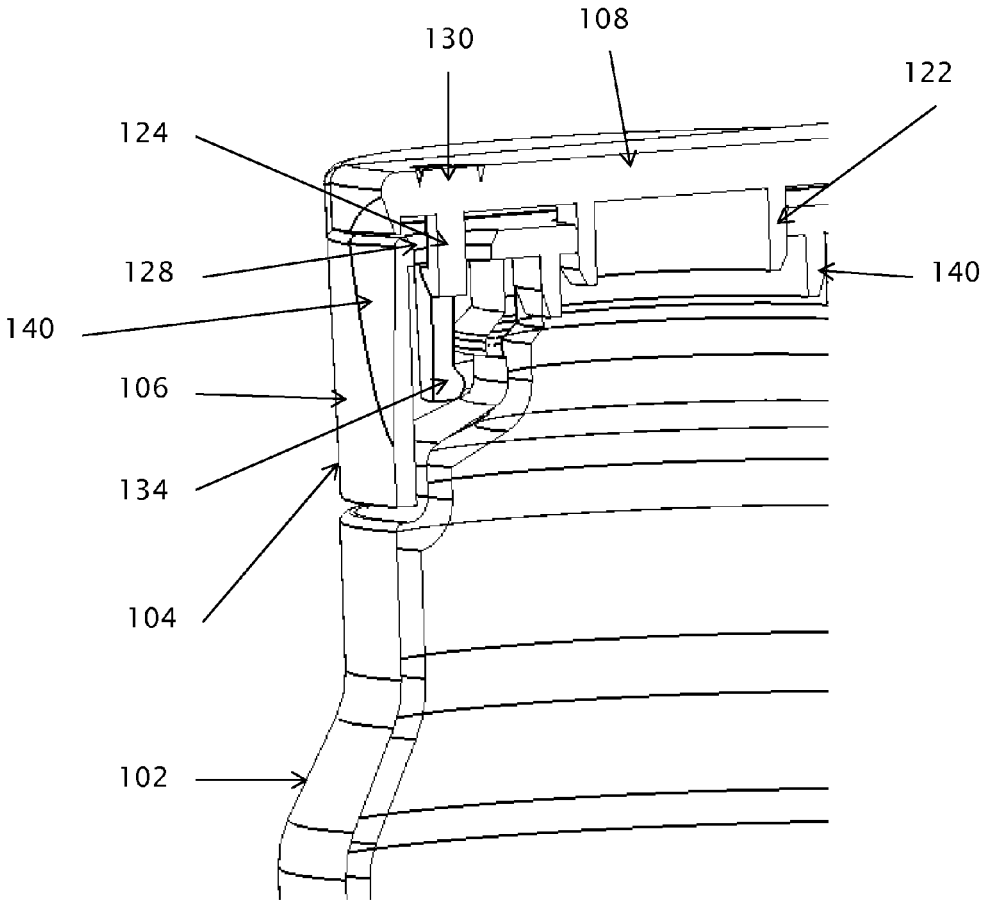
FIG. 8 is a cross sectional view of a portion of an exemplary closure in the initial closed position.

Referring to FIG. 8, shown is a cross sectional view of a portion of an exemplary closure in the initial closed position. Shown in FIG. 8 is container 102 and closure 104. Closure 104 includes closure body 106, tamper evident fingers 124, frangible bridge 130, sealing surface 122, sealing flange 140, capture aperture 128, locking skirt 134, a user engaging portion 142 and lid 108.

Exemplary embodiments of user engaging portion 142 include a recess on closure body 106 configured to receive a finger or thumb of a user so as to apply an opening force to lid 108.

Figure 9:
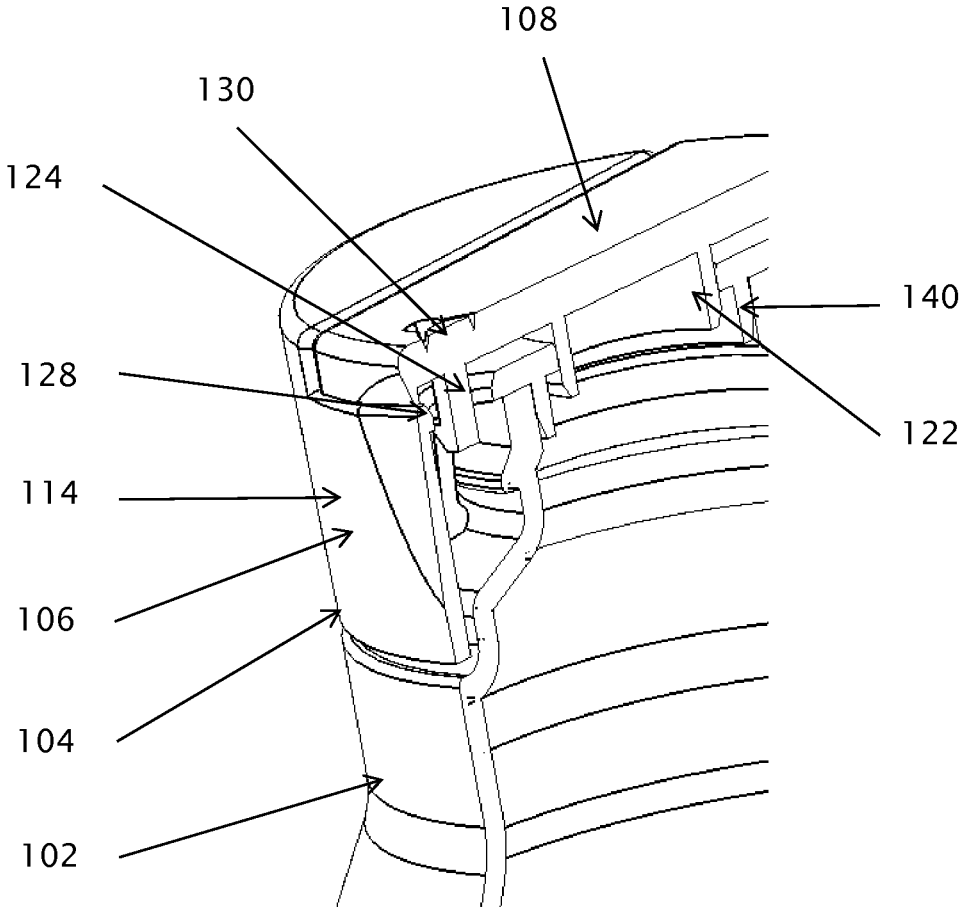
FIG. 9 is a perspective cross sectional view of a portion of an exemplary closure in the initial closed position.

Referring to FIG. 9, shown is a perspective cross sectional view of a portion of an exemplary closure in the initial closed position. Illustrated in FIG. 9 is container 102 and closure 104. Closure 104 includes closure body 106, lid 108, tamper evident fingers 124, frangible bridge 130, sealing surface 122, sealing flange 140, capture aperture 128, and peripheral skirt 114.

Figure 10:
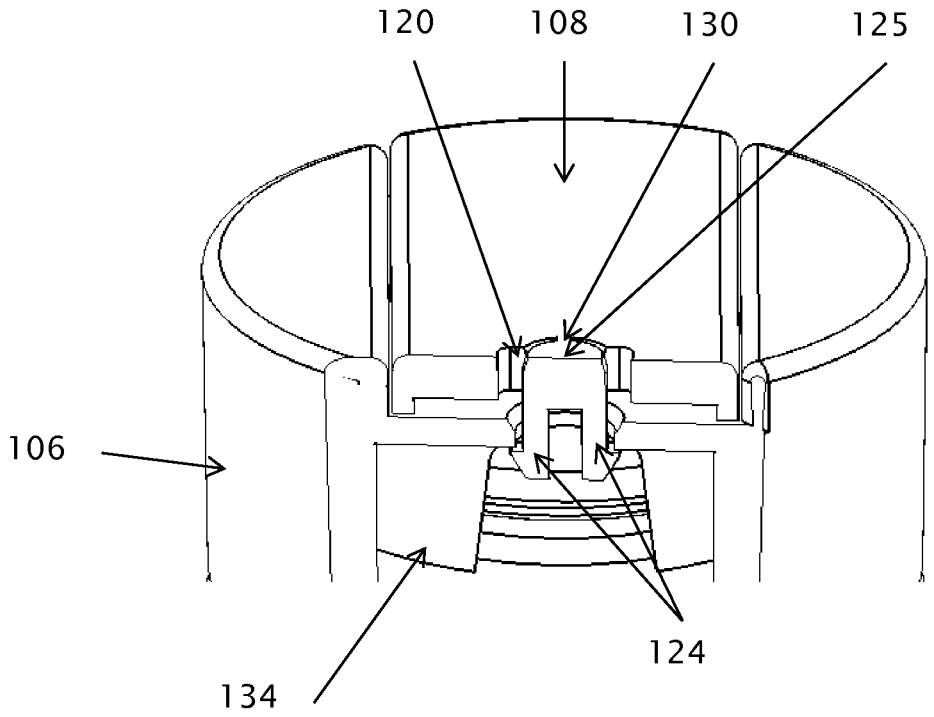
FIG. 10 is a cross sectional view of a portion of the front of an exemplary closure in the initial closed position.

Reference is now made to FIG. 10, which depicts a cross sectional view of a portion of the front of an exemplary closure in the initial closed position. Shown in FIG. 10 is closure body 106, lid 108, tamper evident fingers 124, frangible bridge 130, capture aperture 128, hub 125, confirmation window 120, and locking skirt 134.

Figure 11:
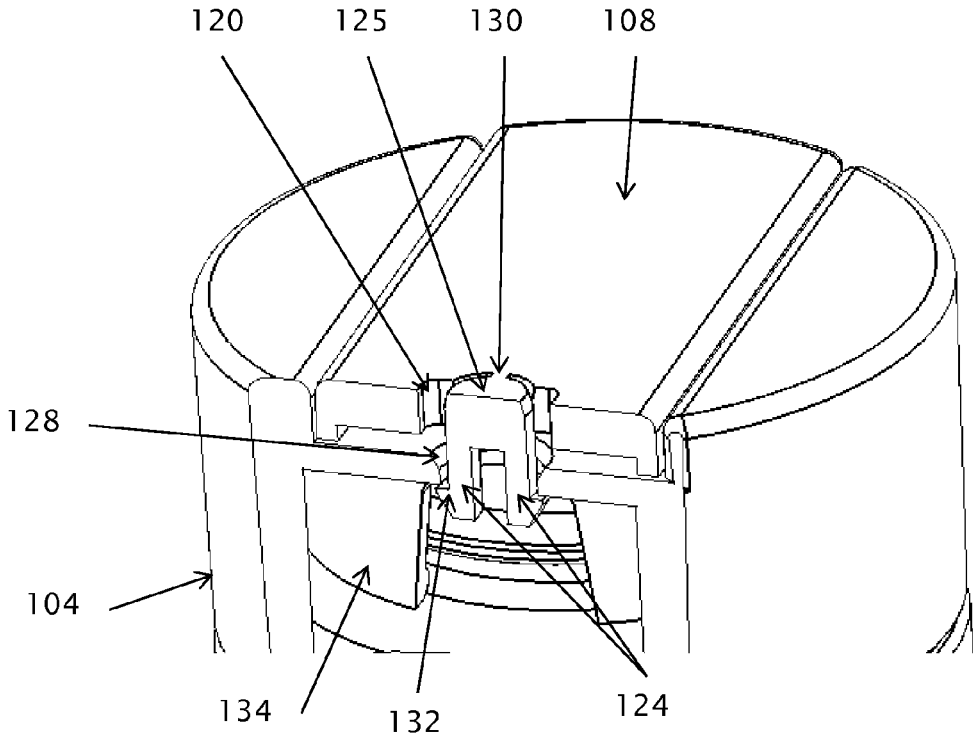
FIG. 11 is a perspective cross sectional view of the front of an exemplary closure in the initial closed position.

Referring to FIG. 11, shown is a perspective cross sectional view of the front of an exemplary closure in the initial closed position. Shown in FIG. 11 is closure 104, lid 108, tamper evident fingers 124, frangible bridge 130, capture aperture 128, hub 125, confirmation window 120, locking skirt 134, and retaining barb 132.

Figure 12:
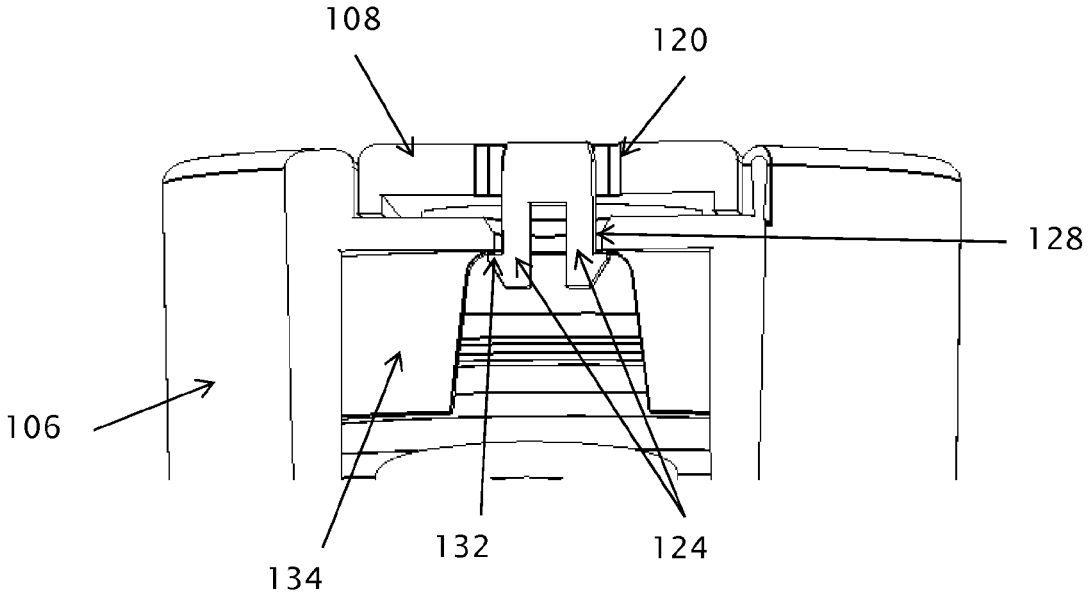
FIG. 12 is a cross sectional view of an exemplary closure in the initial closed position.

Referring to FIG. 12, shown is a cross sectional view of the front of an exemplary closure in the initial closed position. Shown in FIG. 12 is closure body 106, lid 108, tamper evident fingers 124, capture aperture 128, confirmation window 120, locking skirt 134, and retaining barb 132.

It should be appreciated that exemplary embodiments of closure body 106 and lid 108 as shown in FIG. 1-FIG. 12 can be formed from any number of materials including, polymers, thermoplastics and thermosets. In one exemplary embodiment, the closure is HDPE and can be readily used with an HDPE container. In further exemplary embodiment, the closure is formed of polypropylene and has been found compatible with PET containers.

In operation, lid 108 and closure body 106 can be formed in a single injection mold with lid 108 in an open configuration. Lid 108 can then be moved to the closed configuration causing sealing surface 122 of lid 108 to engage dispensing port 126 of closure body 106 and form a sealed interface there between. Simultaneously, tamper evident fingers 124 pass through capture aperture 128 such that the tamper evident fingers 124 flex then urge the retaining barbs 132 to expand outwardly to a diameter greater than capture aperture 128, thereby initially locking lid 108 to the closed position.

Closure 104 is then engaged with container 102 such that sealing flange 140 of closure body 106 forms a sealed interface with container 102. It is understood that closure 104 can be engaged with container 102 prior to the initial closing of lid 108 (to engage the tamper evident fingers 124 with body 106).

Thus, locking skirt 134 and container 102 form a connection that precludes non-destructive separation of closure 104 from container 102. Similarly, tamper evident fingers 124 and the capture aperture 128 (and top wall 110) preclude non-destructive separation of lid 108 from the closed position (or movement of lid 108 to the open position).

Exemplary embodiments of locking skirt 134, tamper evident fingers 124 and frangible bridges 130 are selected such that a force sufficient to break frangible bridges 130 is less than a force sufficient to separate closure body 106 from container 102.

Upon the first opening of lid 108, retaining barbs 132 preclude the tamper evident fingers 124 from moving with lid 108. Thus, the frangible bridges 130 break and the retaining tamper evident fingers 124 (and hub 125) fall from the confirmation window 120, through the capture aperture 128 and into the volume beneath the top wall 110 of closure body 106.

Upon re-closing lid 108, the confirmation window 120 is seen as empty. A user is thus able immediately to determine, by visual inspection, whether container 102 has been previously opened. It is contemplated that friction between the sealing surface 122 of lid 108 and the dispensing port 126 of the closure body 106 can retain the lid in the closed position. Additionally, the lid 108 and closure body 106 can include detents or other friction engagements, as well as snap engagements, to retain the lid in the closed position subsequent to the initial opening of the lid.

Figure 13:
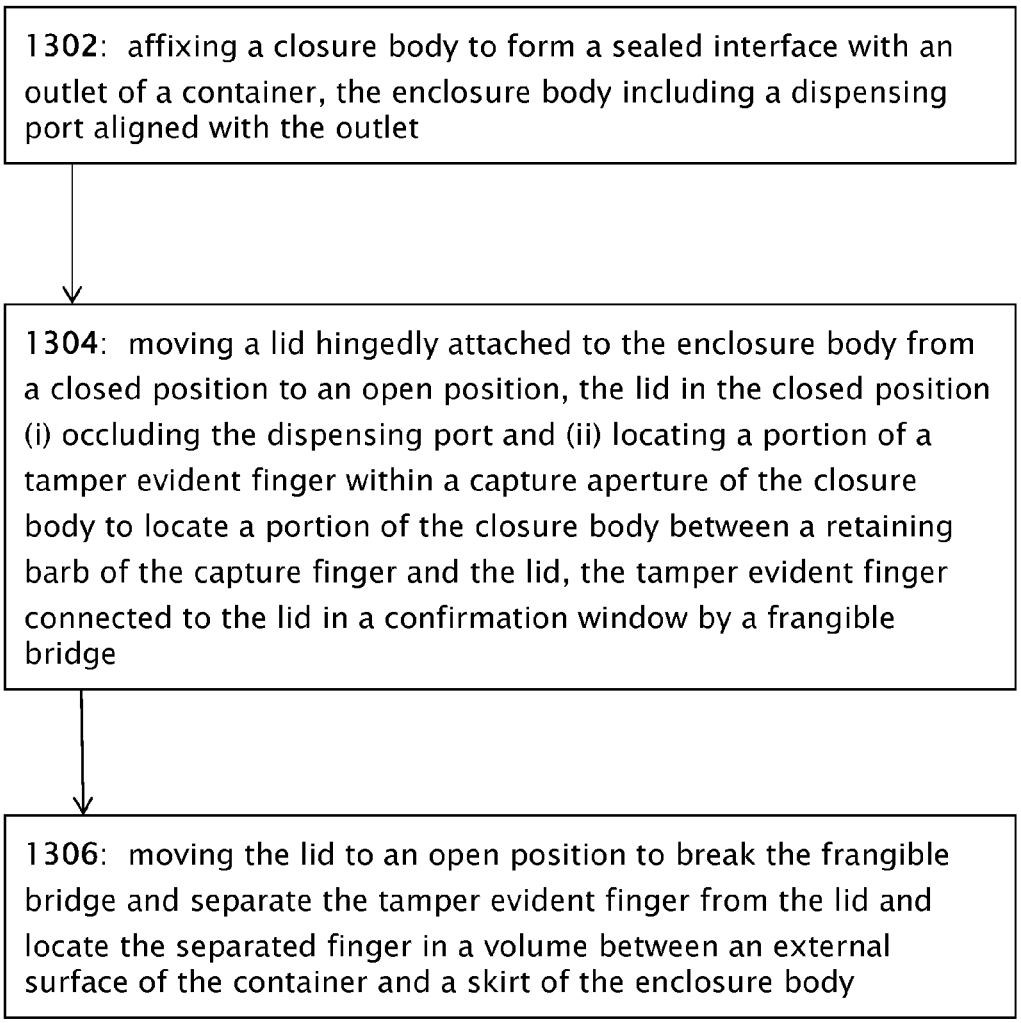
FIG. 13 a logic flow diagram in accordance with a method for performing exemplary embodiments of this disclosure.

Reference is now made to FIG. 13, which presents a logic flow diagram that illustrates a method for performing exemplary embodiments of this disclosure. Block 1302 presents affixing a closure body to form a sealed interface with an outlet of a container, the enclosure body including a dispensing port aligned with the outlet. Block 1304 goes on to state moving a lid hingedly attached to the enclosure body from an open position to a closed position, the lid in the closed position (i) occluding the dispensing port and (ii) locating a portion of a tamper evident finger within a capture aperture of the closure body to locate a portion of the closure body between a retaining barb of the capture finger and the lid, the tamper evident finger connected to the lid in a confirmation window by a frangible bridge. Then block 1306 relates to moving the lid to an open position to break the frangible bridge and separate the tamper evident finger from the lid and locate the separated finger in a volume between an external surface of the container and a skirt of the enclosure body.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A tamper evident closure, comprising:

(a) a closure body having a top wall including a dispensing port aligned with an outlet of a container, a depending peripheral skirt, a sealing flange selected to form a sealed interface with the container and a locking skirt having an engaging boss sized to engage a surface of the container to resist non-destructive separation of the closure body from the container, the top wall further including a capture aperture, wherein the capture aperture exposes a volume beneath the top wall of the closure body; and (b) a lid hingedly connected to the closure body and moveable between an open position and a closed position, the lid including a sealing surface for sealingly engaging the container in the closed position, the sealing surface being spaced from the dispensing port in an open position of the lid, the lid including a first tamper evident finger and a second tamper evident finger projecting from a hub, the first tamper evident finger and the second tamper evident finger including a retaining barb, wherein the closed position of the lid, a portion of the first tamper evident finger and a portion of the second tamper evident finger passes through the capture aperture and a thickness of a local region of the top wall is between the retaining barb and a bottom surface of the lid, the hub connected to the lid in a confirmation window by at least two frangible bridges, the first tamper evident finger and the second tamper evident finger configured to pass through the capture aperture a single time and upon sufficient opening force on the lid, the frangible bridge breaks allowing the lid to move to the open position and the separated hub with the first tamper evident finger and the second tamper evident finger fall through the capture aperture and are retained in the volume beneath the top wall.

2. The tamper evident closure of claim 1, wherein the top wall includes a recessed land to receive the lid in the closed position and form a substantially continuous top surface.

3. The tamper evident closure of claim 1, wherein the sealing flange engages an inside surface of a container outlet.

4. The tamper evident closure of claim 1, wherein the frangible bridges substantially precludes separation of the lid from the closed position.

5. The tamper evident closure of claim 1, wherein the lid circumscribes the hub.

6. The tamper evident closure of claim 1, wherein the closure body and the lid are integral.

7. A method comprising:

(a) affixing a closure body to form a sealed interface with an outlet of a container, the enclosure body including a dispensing port aligned with the outlet;

(b) moving a lid hingedly attached to the closure body from a closed position to an open position, the lid in the closed position (i) occluding the dispensing port and (ii) locating a portion of a first tamper evident finger and a second tamper evident finger within a capture aperture of the closure body to locate a portion of the closure body between a retaining barb of the captured first and second tamper evident fingers and the lid, the first and second tamper evident fingers connected to the lid in a confirmation window by a hub and at least two frangible bridges, wherein the capture aperture exposes a volume beneath a top wall of the closure body; and (c) moving the lid to an open position to break the at least two frangible bridges and separate the hub with the first and the second tamper evident fingers from the lid and the separated hub with the first and second tamper evident fingers fall through in the capture aperture and are retained in the volume beneath the top wall.

8. A closure for a container that has an opening to a container interior where a product may be stored, the closure comprising:

(a) a closure body that is one of (i) a separate structure for being attached to the container at the opening or (ii) a structure formed as a unitary portion of the container at the opening, the closure body having a dispensing orifice aligning with the container opening, the closure body having a top wall including a capture aperture that exposes a volume beneath the top wall of the closure body;

(b) a lid connected to the closure body by a hinge and moveable between a closed position occluding the dispensing orifice and an open position spaced from the dispensing orifice, the lid having a lifting region against which a force can be applied by the user to move the lid from the closed position to the open position; and (c) a hub having a first and a second tamper evident fingers, the hub being frangibly connected to the lid with at least two frangible bridges in a confirmation window, the first and second tamper evident fingers having a retaining barb spaced from an underside of the lid by sufficient distance to locate a portion of the closure body intermediate the retaining barb and the lid in the closed position of the lid; wherein a first movement of the lid from the closed position to the open position fracturing the frangible bridge and permitting movement of the lid from the closed position to the open position and the separated hub with first and second tamper evident fingers fall through the capture aperture and are retained in the volume beneath the top wall.

9. The closure of claim 8, wherein the lid, the hinge and the closure body are integral.

10. The closure of claim 8, wherein the lid, the hinge, the finger and the closure body are integral.

11. The closure of claim 8, wherein the lid circumscribes the hub.

* * * * *